US005897008A

United States Patent [19]

Hansen

[11] Patent Number: 5,897,008

[45] Date of Patent: Apr. 27, 1999

[54] AMPULE WITH OFFSET LONGITUDINAL PASSAGE

[76] Inventor: Bernd Hansen, Heerstrasse 16, D-74429 Sulzbach-Laufen, Germany

[21] Appl. No.: 08/110,958

[22] Filed: Aug. 24, 1993

[30] Foreign Application Priority Data

Sep. 12, 1992 [DE] Germany ..... 42 30 645

[51] Int. Cl.[6] ..... B65D 1/02

[52] U.S. Cl. ..... 215/48; 215/49; 215/383

[58] Field of Search ..... 215/31, 32, 1 C, 215/383, 48, 49; 141/25, 26, 27, 28, 383, 384, 386

[56] References Cited

U.S. PATENT DOCUMENTS

| | | | |
|---|---|---|---|
| 3,900,122 | 8/1975 | Dichter | 215/31 |
| 4,046,145 | 9/1977 | Choksi et al. | 141/27 X |
| 4,172,457 | 10/1979 | Choksi et al. . | |
| 4,192,429 | 3/1980 | Yerman | 215/307 |
| 4,641,663 | 2/1987 | Juhn | 128/765 |
| 4,785,858 | 11/1988 | Valentini et al. | 141/384 X |
| 4,979,630 | 12/1990 | Rose et al. . | |
| 4,995,519 | 2/1991 | Rose et al. | 215/32 |
| 5,006,118 | 4/1991 | Yule | 141/27 X |
| 5,046,627 | 9/1991 | Hansen . | |

*Primary Examiner*—Stephen K. Cronin
*Attorney, Agent, or Firm*—Roylance,Abrams,Berdo & Goodman, L.L.P.

[57] ABSTRACT

An ampule of plastic can have liquid removed from the ampule by an injection member having a conical member at its end. The conical member is introduced into the ampule neck. At least one longitudinal passage is arranged peripherally around the ampule neck inside surface and is displaced from alignment with the longitudinal middle plane of the ampule defined by markings.

11 Claims, 3 Drawing Sheets

AMPULE WITH OFFSET LONGITUDINAL PASSAGE

FIELD OF THE INVENTION

The present invention relates to a plastic ampule containing a liquid removed from the ampule by an injection member or hypodermic syringe, i.e., without a needle. The injection member or hypodermic syringe includes a conical member which is introduced into the neck of the ampule. The ampule body has a marking defining a longitudinal middle plane. The ampule neck has a longitudinal passage on its inside wall to allow inlet of air into the ampule body when liquid is removed from the ampule body.

BACKGROUND OF THE INVENTION

Such ampules are manufactured by blow-molding in a mold comprising of two identical parts of mirror-image construction. Following completion of the blow-molding process, the two parts of the mold are separated from one another in a direction perpendicular to the plane of separation of the mold. Separation of the mold parts enables removal of the ampule from the mold. When several ampules are formed simultaneously, mold separation permits removal of the ampule block from the mold. Separation of the mold parts forms markings on the ampule, which markings define a longitudinal middle plane.

In a known ampule of this type (European Patent 0 326 391 A2 and U.S. Pat. No. 5,046,627 to Hansen, the subject matter of which is hereby incorporated by reference), two longitudinal venting passages are provided which lie in the inside wall of the ampule neck. During removal of the contents from the ampule by an injection member, the cone or conical member of the injection member is introduced into the ampule neck and engages the neck inside wall in a sealed manner. The longitudinal passages permit the inlet of air into the ampule, and are located in the longitudinal middle plane of the ampule.

In the case of this known ampule, erroneous functions of the longitudinal passages often occur due to improper formation. Either insufficient air can flow through the longitudinal passages to allow sufficiently rapid removal of the contents of the ampule, or the liquid in the ampule can leak out through the longitudinal passages, because the longitudinal passages may be manufactured without suitably uniform definition, and therefore, without the required tolerances.

SUMMARY OF THE INVENTION

Objects of the present invention involve forming an ampule with a longitudinal passage or longitudinal passages inside its neck which fulfill the venting requirements without leaking, and can still be manufactured easily and uniformly by the low-cost blow-molding process.

The foregoing objects are obtained by an ampule made of plastic for a liquid to be removed from the ampule by a hypodermic syringe with a conical member at one end thereof to be introduced into the ampule. The ampule comprises an ampule body extending along a longitudinal axis and having a marking thereon defining a longitudinal middle plane. A neck extends along the axis from one axial end of the body. The neck has an inside wall for receiving the conical member. The inside wall has a first longitudinal passage for allowing air to pass into the ampule body between the conical member and the inside wall during removal of liquid from the ampule body. The first longitudinal passage is spaced from the longitudinal middle plane.

Since the longitudinal passage does not lie in the longitudinal middle plane of the ampule, and thus, is not in the plane of separation of the mold in which the ampule is formed, the defining of the longitudinal passage or passages can occur under optimum conditions. The longitudinal passage formation can be promoted by a virtual vacuum pressure in the area of the passage. Each longitudinal passage which is formed then has the correct shape and dimensions. Also, the opening of the mold and the removal of the ampule from the mold do not change the longitudinal passages. The passage holds the shape and dimensions which have been determined dependent upon the removal speed and the viscosity of the liquid contained in the ampule.

In one preferred embodiment, each relevant longitudinal passage is displaced relative to the longitudinal middle plane of the ampule by 90 degrees. This arrangement of the longitudinal passages is especially advantageous with reference to the removal of the ampule from the mold.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings which form a part of this disclosure.

DETAILED DESCRIPTION OF THE INVENTION

An inherently stable ampule 1, manufactured of plastic material in a blow-molding method with use of a mold separated in its longitudinal middle plane, contains a pharmaceutical liquid to be injected by an injection member. A modular, one-piece head 3 is manufactured with and is connected to the neck 2 of ampule 1. Head 3 is configured as one modular piece with a tip-stretched or tip-shaped toggle 4. To maintain sterilization, the ampule body is filled with the liquid while the body is still in the blow mold. Neck 2, head 3 and toggle 4 are shaped in a known manner in accordance with the filling of the ampule body. A ampule 1 is closed at the same time.

Figure 3:
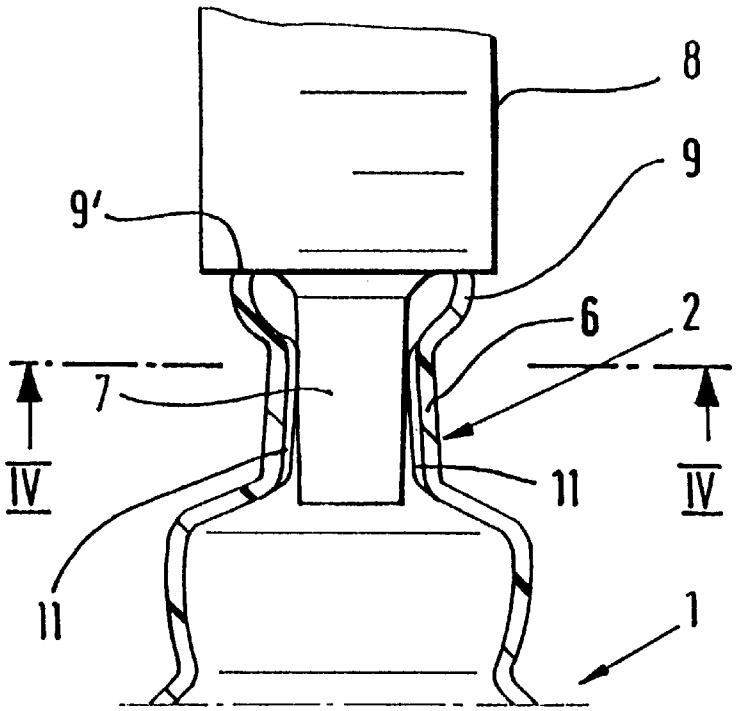
FIG. 3 is an enlarged and partial side elevational view of the ampule of FIG. 1 with the conical member of an injection member inserted, in section taken in a plane perpendicular to the longitudinal middle plane.

A first section 5 of neck 2 is attached to the end of the ampule body opposite the ampule base or bottom. The transverse diameter of section 5 is smaller than that of the ampule body. Following first section 5, neck 2 can have a cylindrical section 6 of smaller diameter. Inside the cylindrical section, a standard cone 7 provided on the front surface of an injection member 8 can be located. As illustrated in FIG. 3, the end of the cylindrical section 6 remote from first section 5 passes into a third section 9. Head 3 is attached through a breaking point, having reduced wall thickness, to third section 9. Head 3 can be separated from neck 2 along the breaking point by a twist or tilt of the toggle 4.

Figure 2:
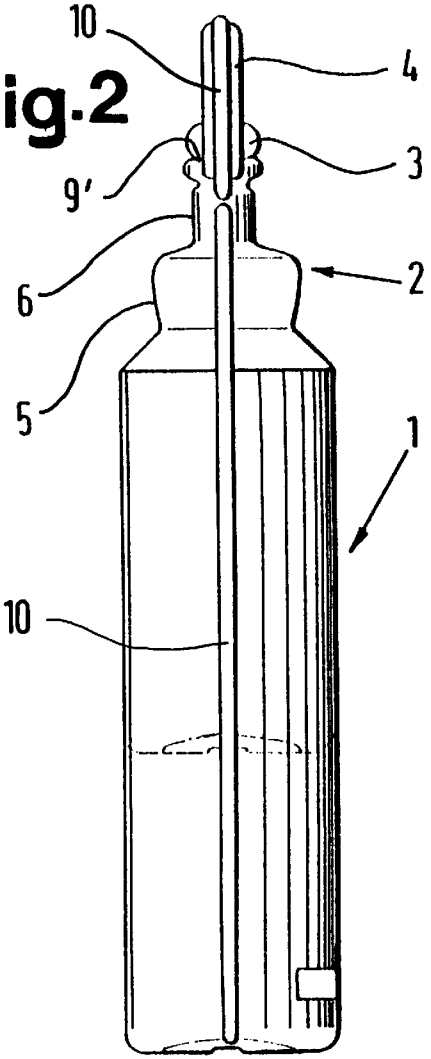
FIG. 2 is a side elevational view of the ampule of FIG. 1 in a position rotated 90 degrees about the longitudinal axis from the position shown in FIG. 1.
Figure 1:
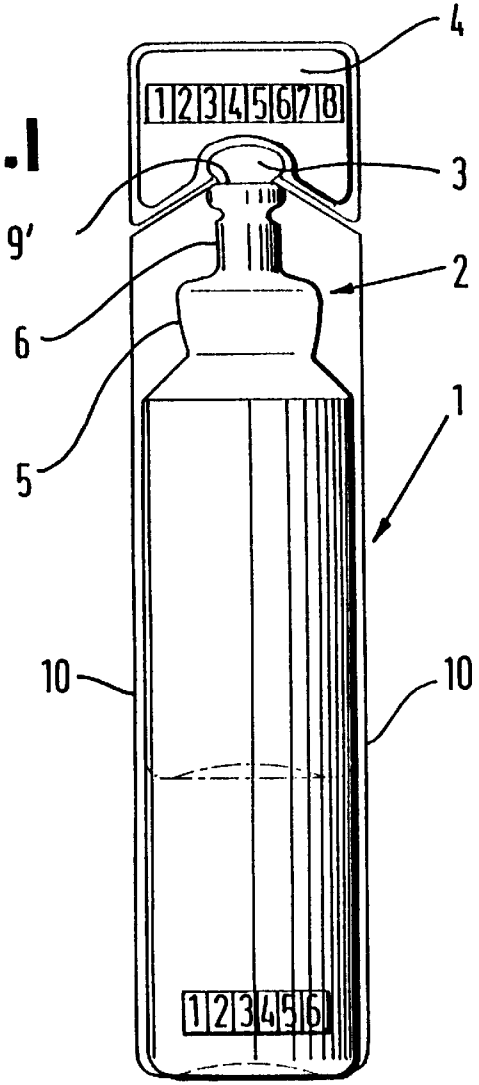
FIG. 1 is a front elevational view of an ampule according to a first embodiment of the present invention with the longitudinal middle plane lying in the drawing plane.
Figure 4:
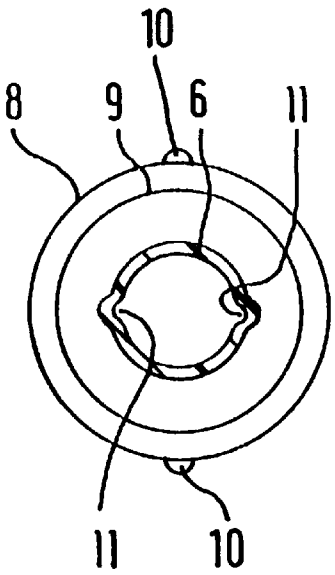
FIG. 4 is plan view in section taken along line IV—IV of FIG. 3.

As shown in FIGS. 3 and 4, two longitudinal passages 11 are formed in the inside wall or surface of section 6 of neck 2. The passages are arranged diametrically opposite to one another in a passage plane. Such passage plane is angularly offset 90 degrees relative to the longitudinal middle plane defined by a circumscribing marking 10 and coinciding with the separation plane of the mold in which the ampule 1 has been manufactured. In FIG. 3, the longitudinal passages 11 extend along the entire length of section 6. The inside surface of section 6 is configured so that between the two longitudinal passages 11, the injection member cone 7 engages the cylindrical section inside surface to form a seal, when the cone has been introduced completely into section 6. This is the case when injection member 8 engages on the free end surface 9' of neck 2, which free end surface is uncovered by the separation of head 3 along the breaking point and forms a contact surface.

In the exemplary embodiment of FIGS. 1–4, cylindrical section 6 of neck 2 has a cylindrical inside diameter which is somewhat smaller than the largest diameter of cone 7, but is somewhat larger than the cone smallest diameter. Cone 7 thus lies along a loop-line or narrow zone on the inside wall of section 6. Alternatively, the inside wall or surface of section 6 could form an inside cone adapted to cone 7.

The shape and diameter of longitudinal passages 11 is selected as a function of the viscosity of the liquid contained in the ampule. In this manner, the liquid can be removed at a flow of the desired velocity, while the liquid is hindered from passing out through longitudinal passages 11 even when, as is often the case, the liquid is removed when the ampule is in a position in which its neck faces or opens downwardly.

Figure 5:
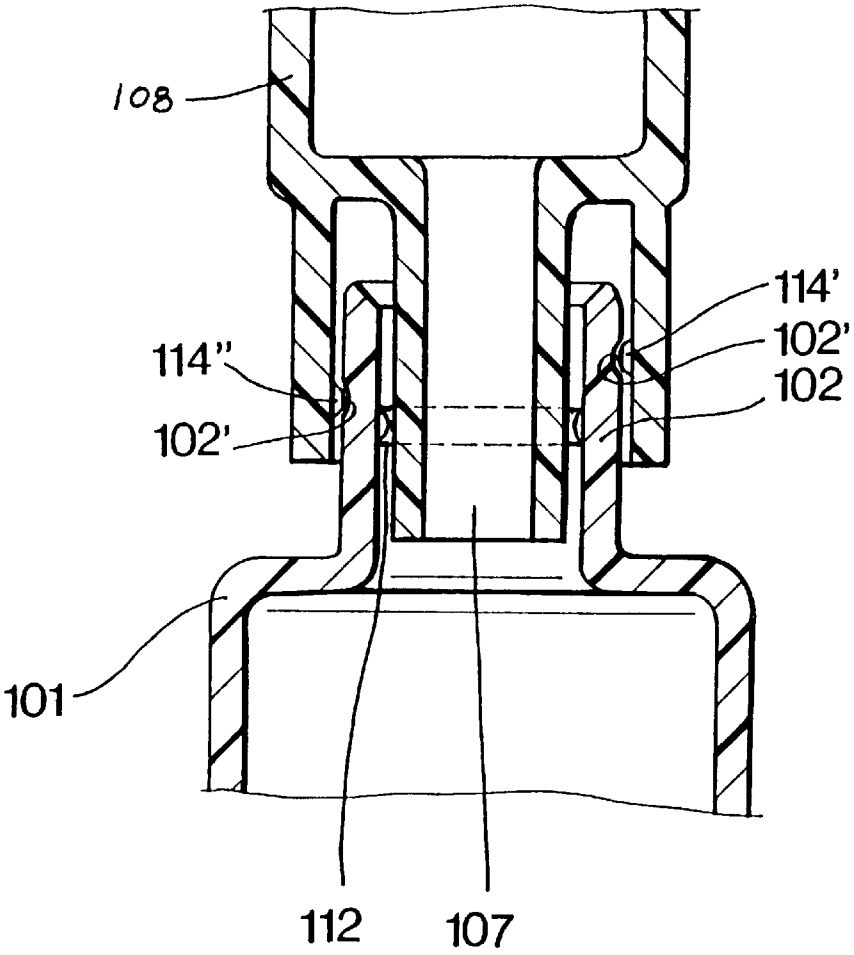
FIG. 5 is a partial front elevational view in section of an ampule according to a second embodiment of the present invention, taken in a plane perpendicular to the longitudinal middle plane.
Figure 6:
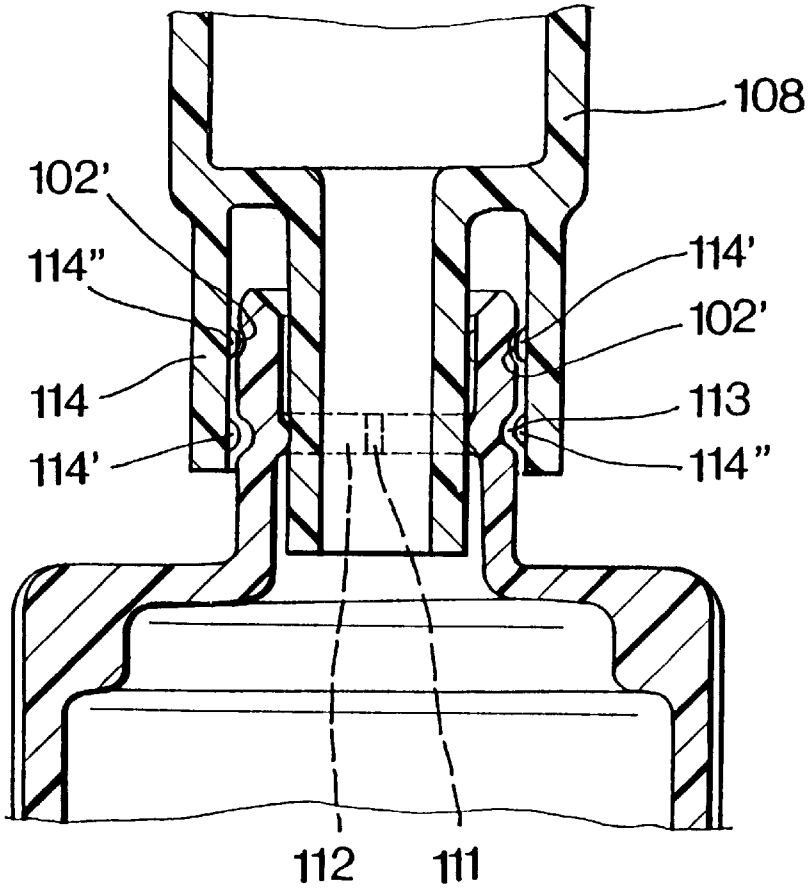
FIG. 6 is a partial side elevational view of the ampule of FIG. 5 in section taken in a plane rotated 90 degrees from the plane section of FIG. 5.

FIGS. 5 and 6 illustrated a second exemplary embodiment of the present invention in which ampule 101 is manufactured in the same manner as the first embodiment, i.e., of plastic, in the blow-molding process with a mold divided along a longitudinal middle plane. The ampule is closed by the manufacturing operation after the filling by a break-closing member configured of one-piece with the ampule neck 102. Ampule neck 102 can be provided with a radially inwardly projecting annular bead 112. The inside diameter of annular bead 112 is adapted to the outside diameter of the tap or cone 107 of an injection member 108, often indicated as a Luer-Lock attachment.

Annular bead 112 extends outside of the longitudinal middle plane of ampule 101, which plane coincides in manufacture with the plane of mold separation. Actually, in the second embodiment, bead 112 is in a plane oriented perpendicular or at a 90 degree angle from this longitudinal middle plane. The bead is provided with two diametrically arranged interruptions, each of which forms a longitudinal passage 111 located displaced from the longitudinal middle plane. Passages 111 are located in a longitudinal plane perpendicular to the longitudinal middle plane. These longitudinal passages 111 are of such dimensions that air can get into the inside of the ampule through them, when the tap or cone 107 is introduced into ampule neck 102 until it engages in a seal manner on annular bead 112. However, no liquid can be discharged, when during removal of the contents from ampule 101, ampule neck 102 is directed downward.

As shown in FIG. 6, the second embodiment of ampule neck 102, at the point of annular bead 112, is provided with a circumferential outer annular groove 113. The shape and diameter of groove 113 corresponds with that of annular bead 112. As shown in FIG. 5, each annular groove 113 can be provided with an interruption aligned with each of the two longitudinal passages 111. The shape of the outside covering surface of ampule neck 102 then corresponds with the shape of its inside covering or lining surface.

As indicated by the second embodiment, the ampule neck can be configured so that the contents of the ampule can also be removed by means of an injection member, which has a so-called Luer-Lock attachment or Luer fitting. In the case of this injection member, the tap or cone 107 is surrounded concentrically at some radial distance by a bushing 114 which is likewise a one-piece modular element with the injection member 108. Bushing 114 is provided on its inside surface with double threading, of which the two threads are indicated as 114' and 114". Ampule neck 102 has a corresponding outside thread arrangement 102', with which threads 114' and 114" come into engagement. Bushing 114 of the Luer-Lock attachment of injection member 108 is not stuck on by merely translating axially relative to the ampule neck, but rather is threaded on. Of course, it is possible that other means can be provided, instead of outside thread 102', i.e., means to facilitate a threaded-like engagement of threads 114' and 114".

The axial length of bushing 114 is shorter than the axial length of the tap or cone 107. The outside diameter of neck 102 is only slightly smaller, over the entire axial length of neck 102, than the inside diameter of bushing 114 of injection member 108.

Of course, it would be possible, even in the case of a neck shape as shown in the embodiment of FIGS. 1–4, to form each of the longitudinal passages by an interruption in an annular bead. In the case of the second embodiment intended to cooperate with a Luer-Lock injection member, the longitudinal passages can also be configured in the same shape as in the first embodiment of FIGS. 1–4, in an area of the ampule neck which is considerably longer in the axial direction than annular bead 12.

While various embodiments have been chosen to illustrate the invention, it will be understood by those skilled in the art that various changes and modifications can be made therein without departing from the scope of the invention as defined in the appended claims.

What is claimed is:

1. An ampule made of plastic for a liquid to be removed from the ampule by a hypodermic syringe with a conical member at one end thereof to be introduced into the ampule, comprising:

an ampule body extending along a longitudinal axis and having marking thereon defining a longitudinal middle plane coinciding with a mold separation plane and with said longitudinal axis; and a neck extending along said axis from one axial end of said body, said neck having an inside wall for receiving the conical member, said inside wall having a first longitudinal passage for allowing air to pass into said ampule body between the conical member and said inside wall during removal of liquid from said ampule body, said first longitudinal passage being spaced from said longitudinal middle plane and located in a plane oriented perpendicular to said longitudinal middle plane, said first longitudinal passage having a shape and dimensions to form means for only allowing air to pass therethrough, but preventing liquid from passing therethrough, when the conical member is fully inserted in said neck.

2. An ampule according to claim 1 wherein said inside wall of said neck comprises a radially inwardly projecting annular bead, said first longitudinal passage being formed by an interruption in said bead.

3. An ampule according to claim 1 wherein said ampule neck comprises outside thread means for engaging an inside thread of a Luer fitting on the hypodermic syringe.

4. An ampule according to claim 1 wherein said marking circumscribes said ampule body and said neck.

5. An ampule according to claim 1 wherein said marking comprises a substantially planar flange extending in said longitudinal middle plane.

6. An ampule according to claim 5 wherein said marking circumscribes said ampule body and said neck.

7. An ampule according to claim 1 wherein said inside wall of said neck comprises a second longitudinal passage for allowing air to pass into said body between the conical member and said inside wall during removal of liquid from said ampule body, said first longitudinal passage being diametrically opposite said second longitudinal passage, said first and second longitudinal passages defining a plane forming a 90 degree angle with said longitudinal middle plane.

8. An ampule according to claim 7 wherein said ampule neck comprises outside thread means for engaging an inside thread of a Luer fitting on the hypodermic syringe.

9. An ampule according to claim 7 wherein said inside wall of said neck comprises a radially inwardly projecting annular bead, each of said longitudinal passages being formed by an interruption in said bead.

10. An ampule according to claim 9 wherein said neck comprises an outer surface with an annular groove laterally adjacent said bead, said annular groove having interruptions aligned with said interruptions in said bead.

11. An ampule made of plastic for a liquid to be removed from the ampule by a hypodermic syringe with a conical member at one end thereof to be introduced into the ampule, comprising:

an ampule body extending along a longitudinal axis and having a marking thereon defining a longitudinal middle plane coinciding with a mold separation plane and with said longitudinal axis; and a neck extending along said axis from one axial end of said body, said neck having an inside wall for receiving the conical member, said inside wall having a first longitudinal passage for allowing air to pass into said ampule body between the conical member and said inside wall during removal of liquid from said ampule body, said first longitudinal passage being spaced from and located in a plane perpendicular to said longitudinal middle plane, said first longitudinal passage having a shape and dimensions to form means for only allowing air to pass therethrough, but preventing liquid from passing therethrough, when the conical member is fully inserted in said neck, said inside wall of said neck including a radially inwardly projecting annular bead, said first longitudinal passage being formed by an interruption in said bead, said neck including an outer surface with an annular groove laterally adjacent said bead, said annular groove having interruptions aligned with said interruptions in said bead.

* * * * *